US005997129A

United States Patent [19]

Matsuhashi

[11] Patent Number: 5,997,129

[45] **Date of Patent: *Dec. 7, 1999**

[54] INK-JET PRINTER FOR PRINTING ACROSS AN ENTIRE SURFACE OF A RECORDING MEDIUM

[75] Inventor: Kunihiko Matsuhashi, Suwa, Japan

[73] Assignee: Seiko Epson Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/545,943

[22] Filed: Oct. 20, 1995

[30] Foreign Application Priority Data

Oct. 21, 1994 [JP] Japan ..... 6-256868
Sep. 6, 1995 [JP] Japan ..... 7-229543

[51] Int. Cl.[6] ..... B41J 2/165

[52] U.S. Cl. ..... 347/35

[58] Field of Search ..... 347/29, 33, 35, 347/92, 93, 37, 39, 19, 4, 180, 215, 218

[56] References Cited

U.S. PATENT DOCUMENTS

| | | | |
|---|---|---|---|
| 4,333,087 | 6/1982 | Yamaguti | 347/93 |
| 5,291,227 | 3/1994 | Suzuki | 347/35 |
| 5,536,092 | 7/1996 | Yamguchi | 400/231 |

FOREIGN PATENT DOCUMENTS

| | | | |
|---|---|---|---|
| 0 345 018 A1 | 12/1989 | European Pat. Off. . | |
| 0 451 460 A2 | 10/1991 | European Pat. Off. . | |
| 0 526 154 A2 | 2/1993 | European Pat. Off. . | |
| 0 616 893 A2 | 9/1994 | European Pat. Off. . | |
| 4-286655 | 10/1992 | Japan | B41J 2/18 |
| 6-166175 | 6/1994 | Japan | B41J 2/01 |

*Primary Examiner*—N. Le
*Assistant Examiner*—Thien Tran
*Attorney, Agent, or Firm*—Loeb & Loeb

[57] ABSTRACT

An ink-jet printer is provided capable of performing a printing operation across the entire width of a recording medium such as a tape without producing a non-printed area at edges of the recording medium. In the ink-jet printer, the printing position is defined by an guide element disposed so that the guide element faces an ink-jet print head. The guide element is provided with excess ink capturing apparatus having a mesh screen with a size greater than the width of the tape being carried, and also provided with an ink absorbing surface disposed at the back of the above-described screen. To perform a solid printing operation onto the tape, the printing range is set greater than the tape width without producing a non-printed area at the edges. The ink droplets which are ejected from the print head when the print head is located in regions outside the tape are all absorbed into an ink absorber via the mesh screen disposed at the surface of the guide element thereby enduring that the surface of the tape is not dirtied with ink.

39 Claims, 10 Drawing Sheets

INK-JET PRINTER FOR PRINTING ACROSS AN ENTIRE SURFACE OF A RECORDING MEDIUM

FIELD OF THE INVENTION

The present invention relates to a printer having a print head of the ink-jet type. More specifically, the present invention relates to an ink-jet printer capable of performing a solid printing operation across the entire surface of a recording medium such as a tape without producing a non-printed area.

BACKGROUND AND SUMMARY OF THE INVENTION

Various types of ink-jet printers are known in the art. In these types of printers, maximum printing areas are defined for individual standard sizes of recording media. In general, the maximum printing area is defined in terms of top-, bottom-, right- and left-margins so that the printing area is smaller than the size of a recording medium by the amount defined by the margins. Each margin is set to a value in the range from 3 mm to 13 mm, and no printer has been proposed which can perform a printing operation in an area including the end portion of the recording medium.

Furthermore, in another known small-sized ink-jet printer, a tape having a color selected from various colors can be employed as the recording medium, and color printing can be performed onto the selected tape. In the small-sized ink-jet printer of this type, a color printing operation is performed onto a tape with inks supplied to ink-jet print heads from ink tanks for color inks of cyan (C), magenta (M), and yellow (Y).

As for the tape, it is known to provide a tape which has a releasable sheet covering the back surface of the tape via an adhesive layer. After completion of printing, the tape is cut into a piece having a proper size. Then the releasable sheet is removed and the tape is affixed to a desired object. The printer of the type designed to perform a printing operation onto this type of tape is called a label printer or label word processor and is now popular in the market.

However, when the conventional ink-jet printer is used to perform a solid printing operation across the entire area of a recording medium such as a tape, there occurs a problem in that a non-printed area is produced at an end portion of the width of the tape.

To perform a solid printing operation by moving a print head in a reciprocating fashion across the width of a tape without producing a non-printed area at the edges of the tape, it is required to start a printing operation at one end of the width of the tape and stop the printing operation at the other end of the width of the tape.

However, it is generally difficult to precisely drive the print head so that the printing operation is started precisely at one edge of the width of the tape and is stopped precisely at the other edge of the width of the tape. This difficulty arises from a slight deviation in the tape carrying position in a direction across the width of the tape, or from a timing error between the ink ejection operation and the reciprocating movement of the print head.

If the printing operation is not controlled precisely, a non-printed area is produced at a region near the edge of the width. This could occur, for example, if the start of the printing operation is delayed from the time at which the print head is at the edge of the width of the tape.

In view of the above, it is an object of the present invention to provide an ink-jet printer capable of performing a printing operation for a limited area at an edge of the width or the entire area of the tape without producing a non-printed part in the selected area, or across the entire width or along the entire length of the tape without producing a non-printed part in the selected direction (hereafter, these printing operation modes are represented by a generic term "solid printing mode").

Furthermore, it is another object of the present invention to provide an ink-jet printer that does not make a recording medium dirty with ink droplets which are deposited on a guide element or the like during a solid printing operation.

It is a further object of the present invention to provide a recording medium suitable for use with an ink-jet printer capable of performing a solid printing operation.

To achieve the above objects, the present invention provides an ink-jet printer in which a print head is controlled so as to make possible performing a printing operation in an area which is deviated outward from the leading or trailing edge or either side of a recording medium such as a tape being carried (this printing operation will also be referred to as a "passing-over" printing operation). With this arrangement, the print head is driven in such a manner that the printing operation is performed continuously until the print head has moved past the edge of the width of the length of the recording medium thereby accomplishing the solid printing operation without producing a non-printed area at the end portion of the recording medium.

Furthermore, in addition to the above construction, the ink-jet printer of the present invention also has excess ink capturing means for capturing the ink droplets which are ejected from the print head when the print head is at a passing-over position. According to this technique, it is possible to avoid the deposit of the ejected ink droplets onto the guide element disposed facing the print head and thus it is possible to prevent the following recording medium from being dirtied with the deposited ink.

More specifically, according to an aspect of the present invention, there is provided an ink-jet printer comprising: a recording medium supplying source; a carrying path along which a recording medium supplied from the recording medium supplying source is carried; recording medium carrying means for carrying the recording medium along the carrying path; an ink-jet print head disposed on the carrying path, the ink-jet print head being adapted to move in a reciprocating fashion along a first direction relative to the recording medium to be carried; ink supplying means for supplying ink to the print head; and printing operation control means having the capability of setting the printing range of the print head in the first direction so that the printing range includes a region outside the edge of the recording medium.

In the above-described ink-jet printer, the printing range in the first direction, that is the range in which a solid printing operation is possible, is for example a direction across the width of the recording medium perpendicular to the carrying direction along which the recording medium is carried. Alternatively, the first direction may be a direction along the length of the recording medium parallel to the carrying direction along which the recording medium is carried. Furthermore, it is also possible to set the printing range in such a manner that, in addition to the first direction, the printing range also includes an area which is deviated outward from an edge of the recording medium in a second direction different from the above first direction. For example, if the first and second directions are selected so that they are perpendicular to each other, it is possible to accomplish a solid printing operation over the entire area of a recording medium.

In another aspect of the invention, the ink-jet printer further includes excess ink capturing means for capturing the ink droplets which are ejected from the print head when the print head is located at a position deviated outward from the edge of the recording medium.

The above-described excess ink capturing means is disposed at a location facing the printing head via the carrying path, and the excess ink capturing means is formed over the entire range including the printing range of the print head, wherein the printing range includes an area outside the edge of the recording medium. To achieve such a construction, the excess ink capturing means is disposed on a guide element which defines the position of printing performed by the print head onto the recording medium being carried. In this case, the surface of the guide element facing the recording medium can be formed of a stainless steel mesh.

Furthermore, it is desirable that the excess ink capturing means include ink exhausting means for exhausting captured ink thereby preventing the excess ink capturing means from becoming full of the captured ink and thus maintaining the capability of capturing excess ink droplets.

In the case of an ink-jet printer for performing a printing operation onto a large-size recording media, it is not economical to dispose the excess ink capturing means across the entire width or along the entire length. The above problem can be avoided if the excess ink capturing means is adapted to move in one piece with the print head. This construction may also be applied to a small-size recording medium.

A tape having a great length and having a constant width can be employed as the recording medium. In this case, a tape cartridge can be employed as the recording medium supplying source in which the tape, wound in the form of a roll, is accommodated wherein the tape cartridge is adapted to be removably mounted in the main part of the ink-jet printer.

In this case, the tape cartridge can accommodate various tapes having different widths. Therefore, to make it possible to correctly set the printing range of the solid printing operation corresponding to the width of a tape used, the tape cartridge further includes width indication means for indicating the width of the tape accommodated in the tape cartridge; the printing operation control means includes reading means for reading the width indicated by the width indication means; and the printing range of the print head in the first direction is set according to the width read by the reading means so that the printing range includes an area outside the edge of the recording medium.

Furthermore, a transparent medium such as a transparent tape may be employed as the recording medium.

DETAILED DESCRIPTION OF THE PREFERRED EMBODIMENT

Figure 1:
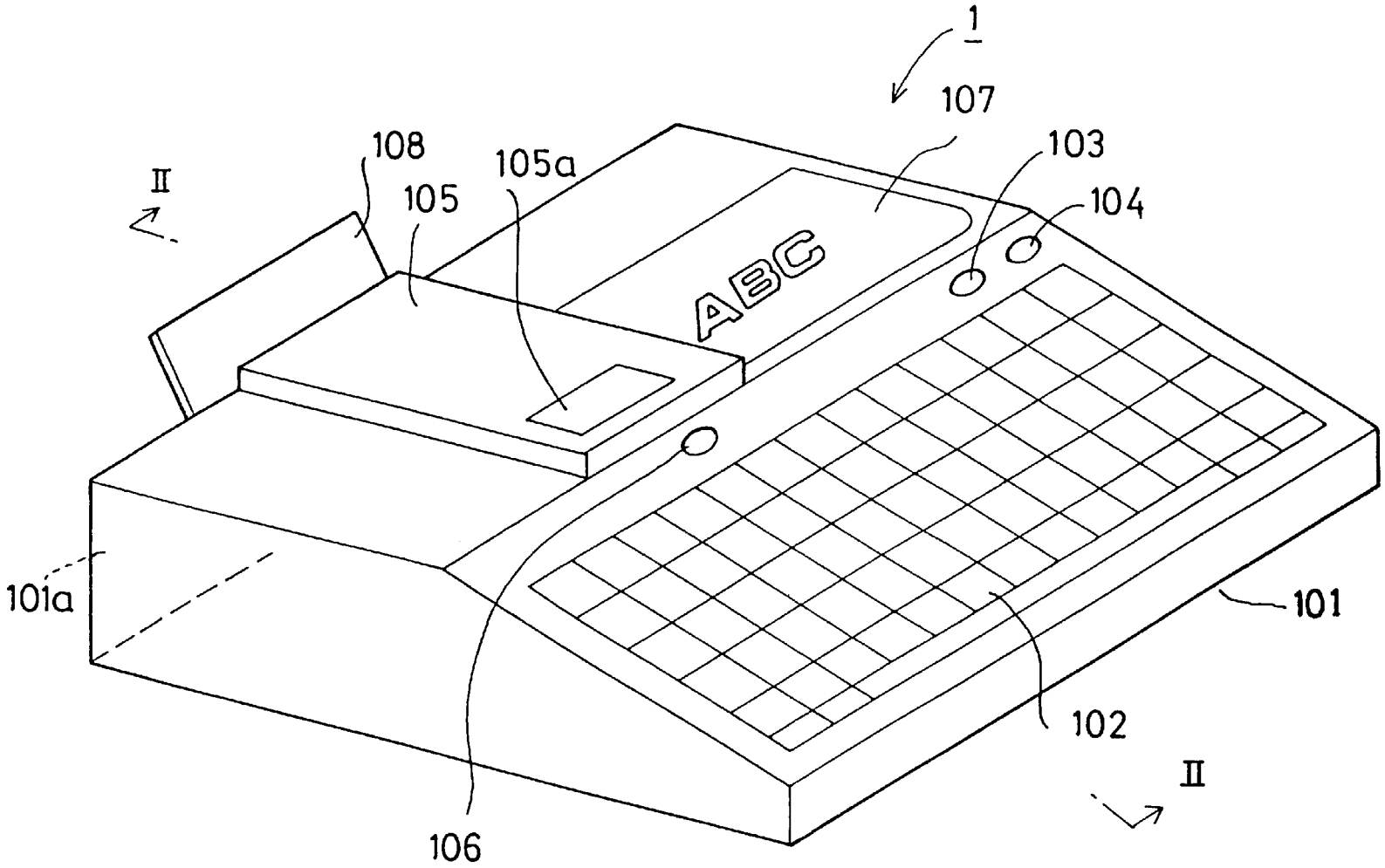
FIG. 1 is a perspective view illustrating the external appearance of an ink-jet printer according to a first embodiment of the present invention.

In the ink-jet printer according to the present invention, when a solid printing operation is performed across the entire width or along the entire length of a recording medium without producing a non-printed area, the printing operation control means sets the printing range to a wide range including the entire width or the entire length of the recording medium so that the printing operation by means of the print head starts at a position prior to the starting edge of the recording medium being carried, and the printing operation stops at a position beyond the ending edge of the recording medium. If the printing operation is started at a position sufficiently apart from the starting edge, and ended at a position sufficiently apart beyond the ending edge, a non-printed area is not produced in either end area.

The ink droplets, which are ejected from the print head before the print head reaches the starting edge of the recording medium and after the print head has passed the ending edge, are captured by the excess ink capturing means. Therefore, it is possible to prevent the ink droplets ejected during the extended printing operation from depositing on the surface disposed facing the print head, and thus it is possible to prevent the following recording medium from becoming dirty with the deposited ink.

Referring to the drawings, embodiments of the present invention will be described below.

Figure 2:
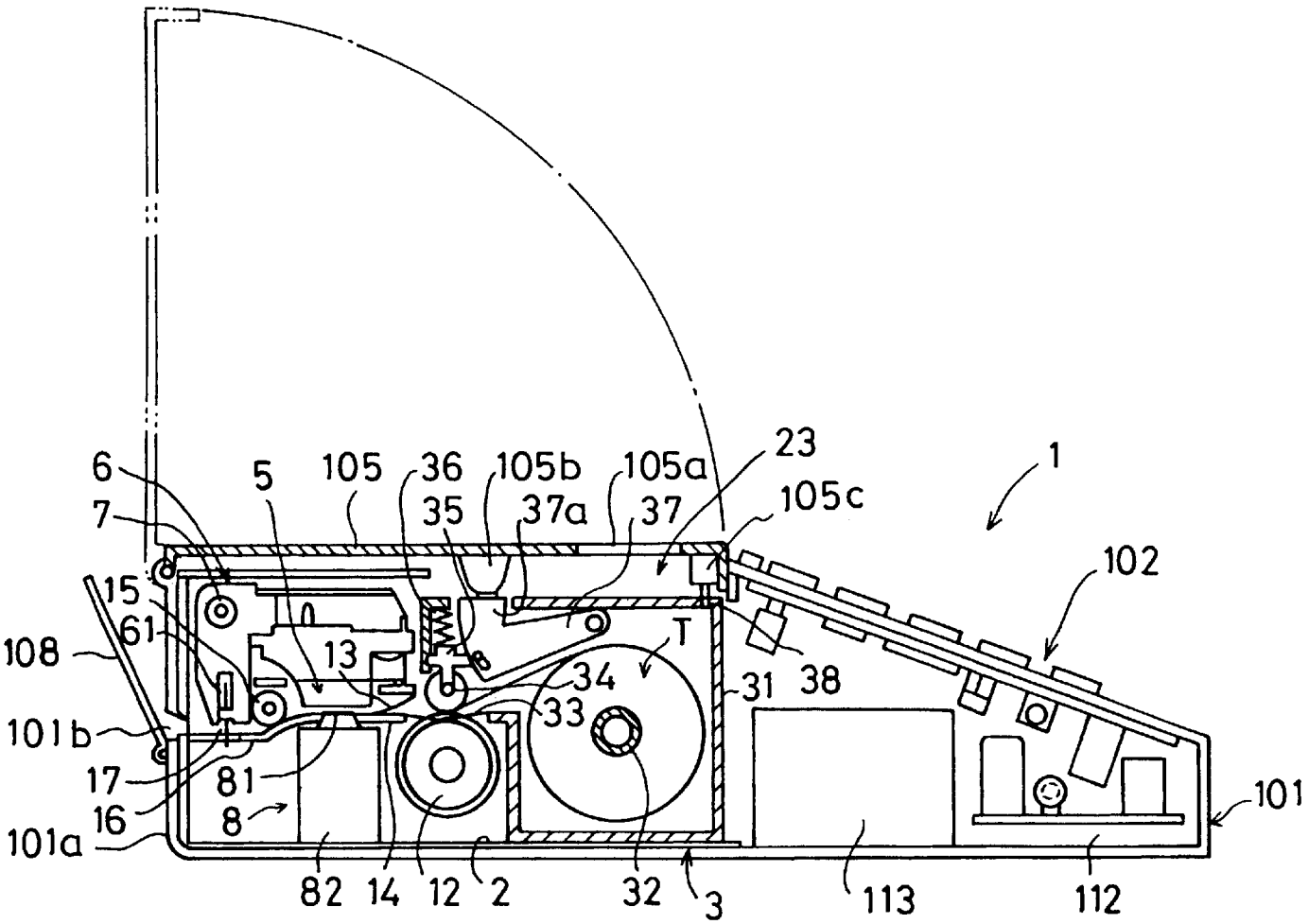
FIG. 2 is a cross-sectional view of FIG. 1 taken along line II—II.

As stated above, FIG. 1 is a perspective view illustrating the external appearance of an ink-jet printer according to the present invention. FIG. 2 is a cross-sectional view of FIG. 1 taken along line II—II. The ink-jet printer 1 representing a first embodiment of the present invention is of the type called a "label printer" or "label word processor" for performing a printing operation onto the surface of a tape whose back surface is covered with a releasable sheet via an adhesive layer.

Referring to FIGS. 1 and 2, the ink-jet printer 1 has a thin casing 101 in the form of a generally rectangular prism. The front half part of the upper plate of the casing 101 forms an operation control panel 102. Various keys such as a print button 103 for stating a printing operation and a power switch button 104 are disposed on the operation control panel 102. An open-and-close lid 105 is disposed on the top of the rear half part of the casing 101. The open-and-close lid 105 can be opened and closed by means of rotation about the rear end. If a lid open-close button 106 disposed on the operation control panel 102 is pressed, the lock is released and the open-and-close lid 105 is opened so that the inside of the casing 101 can be seen from the side of the operation control panel 102.

In a region which appears when the lid 105 is opened, there is a mounting part 23 in which a tape cartridge described later can be mounted. Thus, the tape cartridge 3 can be mounted into or removed from the mounting part when the lid 105 is open. The lid 105 has a transparent window 105*a* through which a user can see whether a tape cartridge 3 is mounted or not. A liquid crystal display unit 107 for displaying character information input via the keys on the operation control panel 102 is disposed in an area adjacent to the lid 105.

A tape outlet 101*b* is formed in the rear side face 101*a* of the casing 101 so that a printed tape is carried out through the tape outlet 101*b*. When the printed tape is carried out through the tape outlet 101*b*, the tape is guided by a tape carrying-out guide plate 108. A power source unit 112 and a battery 113 such as a nickel-cadmium battery are disposed in the inside of the casing 101, below the operation control panel 102.

Figure 3:
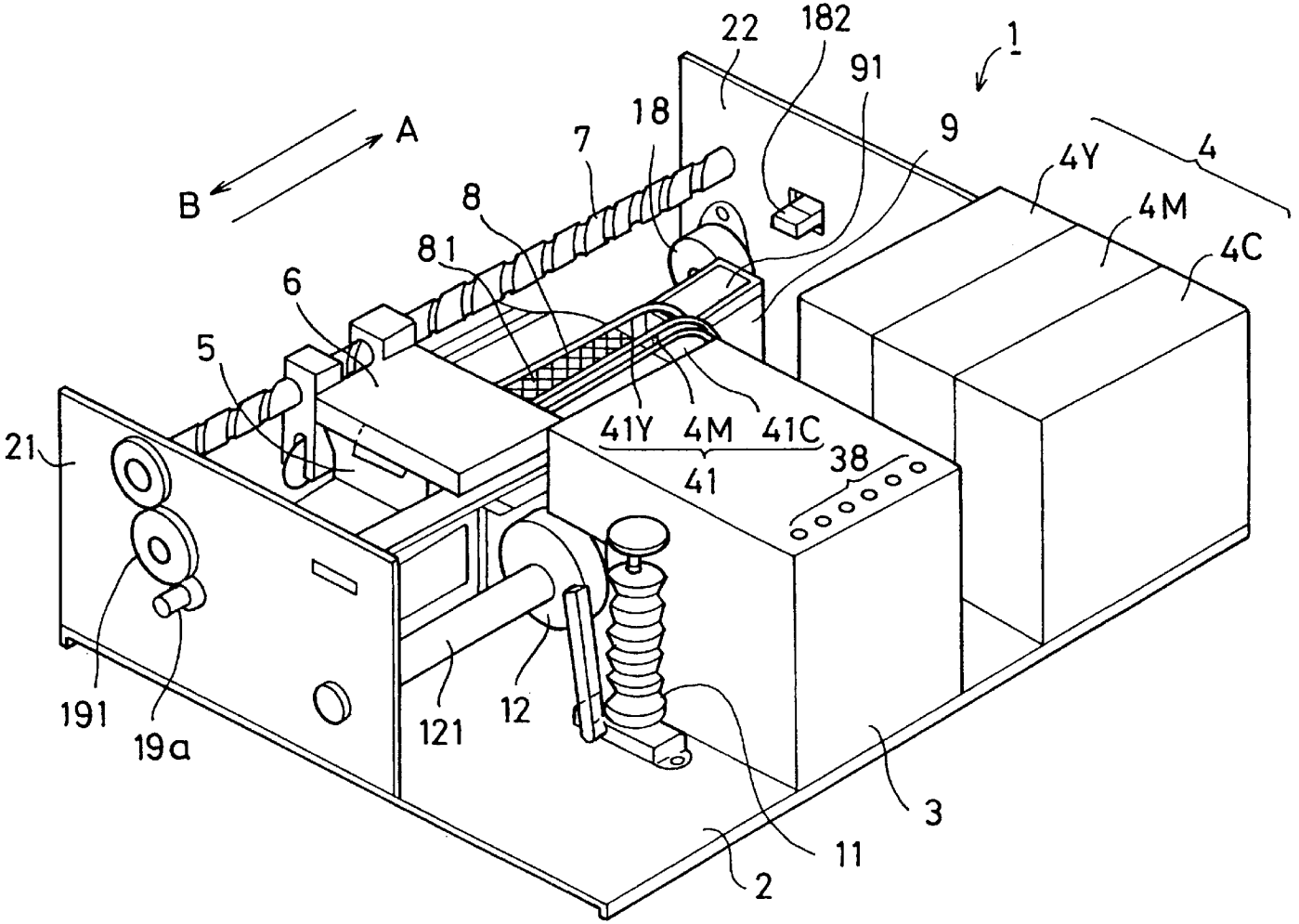
FIG. 3 is a schematic diagram illustrating the main elements of the printer shown in FIG. 1.

FIG. 3 is a schematic diagram illustrating the main elements of the ink-jet printer 1 disposed inside the casing 101. In FIG. 3, reference numeral 2 denotes a base on which the elements are mounted, wherein the base 2 is placed on the bottom plate of the casing 101. The tape cartridge 3, three ink tanks 4 (4C, 4M, 4Y), and an ink-jet print head 5 are disposed on the base 2. The print head 5 is held on a head carriage 6. The head carriage 6 is supported by a lead screw 7 extending in space between the right and left side-plates 21 and 22 of the base 2. The carriage 6 is also supported by a guide axis (not shown) disposed in parallel to the lead screw 7 so that the carriage 6 can move left and right (along the lead screw) without rotation. That is, if the lead screw 7 is rotated, the head carriage 6 and the print head 5 held by the head carriage 6 move in left and right directions (in first directions) denoted by arrows A and B in FIG. 3.

A tape guide element 8 is disposed at the center of the movement range of the print head 5 in such a manner that the tape guide element 8 faces the print head 5. The tape guide element 8 is an element corresponding to a platen disposed facing a print head of a printer such as a thermal printer according to other techniques, and the tape guide element 8 defines a printing position of the print head 5.

Figure 5:
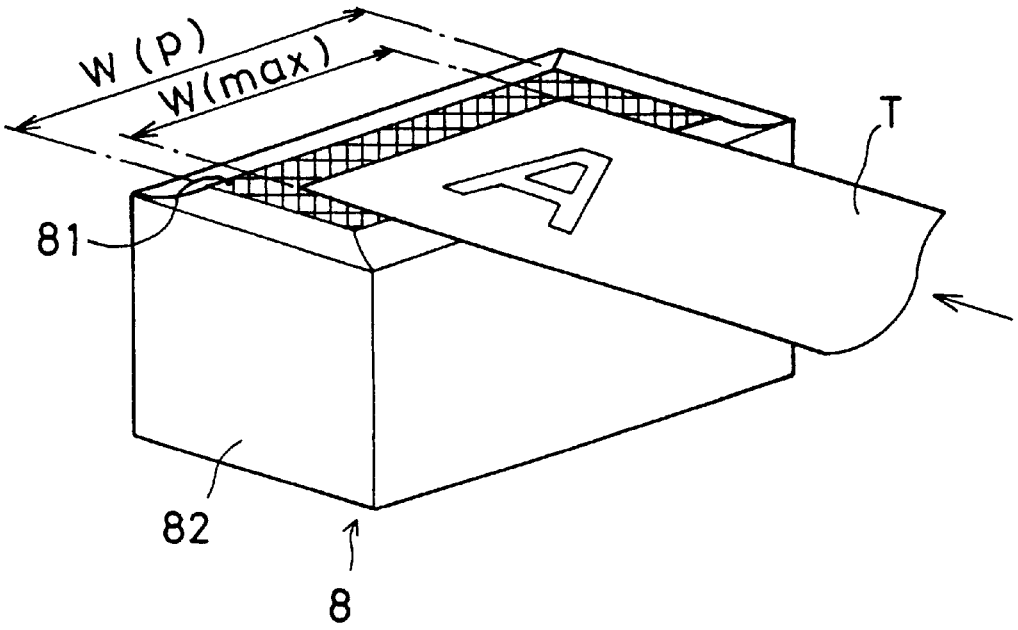
FIG. 5 is a schematic diagram illustrating a paper guide element used in the printer shown in FIG. 1.

In the present embodiment, the tape guide element 8 forms excess ink capturing means. As shown in FIG. 5, the top surface of the guide element of the present embodiment is formed of an ink filter 81 capable of capturing ink wherein the captured ink can pass through the filter. The ink filter 81 may be made of, for example, stainless steel in the form of a mesh. The ink filter 81 is attached to the surface of an ink absorber 82 in the form of a rectangular prism of an ink absorbing material. Thus, the ink captured on the surface of the guide element 8 passes through the ink filter 81 and is then absorbed by the ink absorber 82.

Referring again to FIG. 3, a head capping mechanism 9 is disposed between the guide element 8 and the side-plate 22. The head capping mechanism 9 is located at a position deviated from the path along which the print head 5 moves during a printing operation. When the print head 5 is not in use, the print head 5 moves to the head capping mechanism 9 and is held there in a state in which the print head 5 is capped by a cap face 91 of the capping mechanism 9. At the side of the tape cartridge 3 is an ink pump 11 which is operated manually before starting a printing operation so as to forcibly supply ink from the ink tanks 4 to the print head 5.

Figure 4:
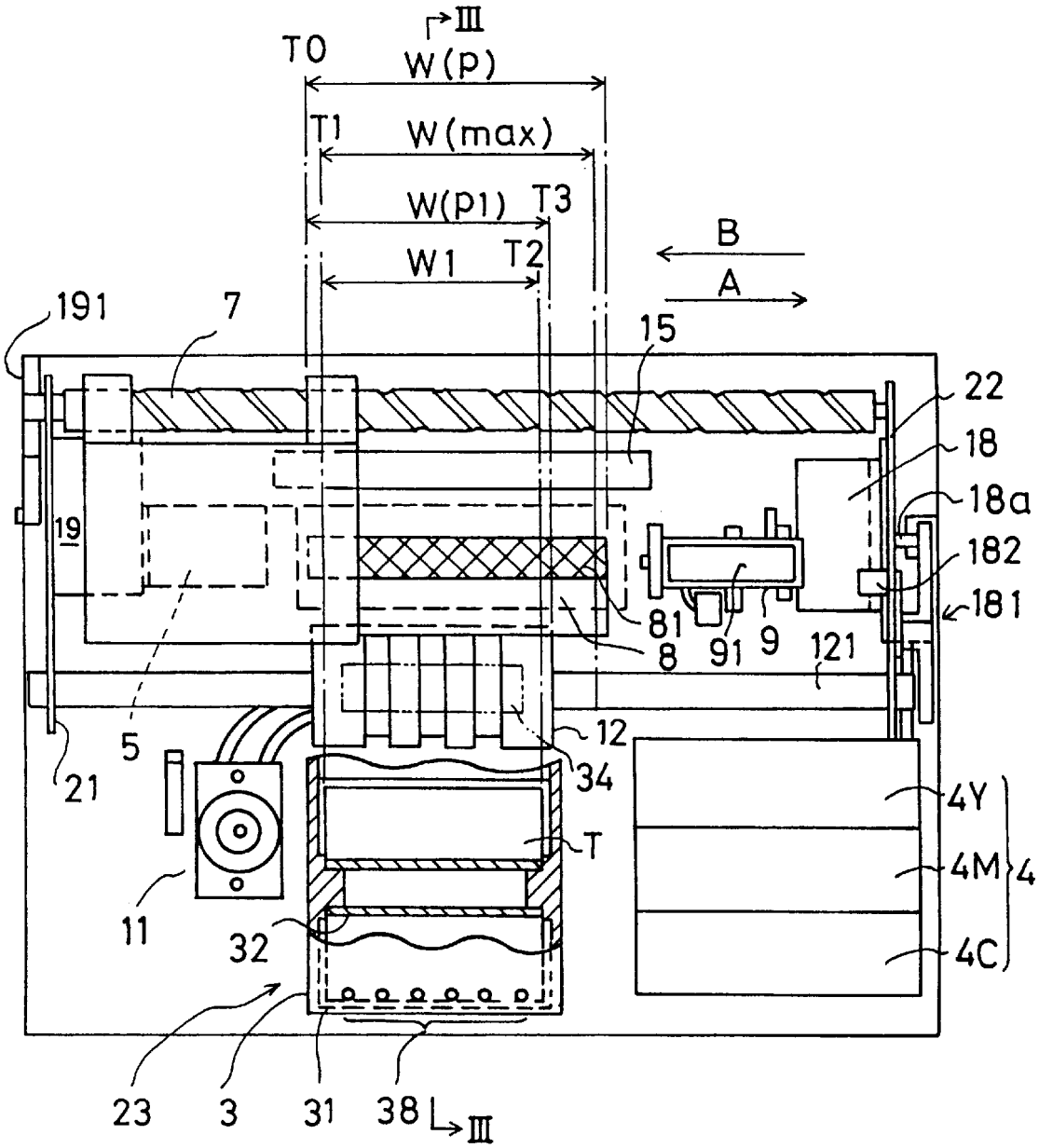
FIG. 4 is a schematic diagram illustrating the main elements, seen from above, of the ink-jet printer of FIG. 1.

FIG. 4 illustrates the layout, seen from above, of the main elements of the ink-jet printer 1 according to the present embodiment. Referring to FIG. 4 as well as other figures, the main elements of the ink-jet printer 1 of the present embodiment will be described below in detail.

The tape cartridge 3 includes a case 31 having a particular thickness, a core axis 32 accommodated in the case 31 in such a manner that the core axis 32 can rotate, and a tape T having a particular width W1 wherein the tape T is wound around the core axis 32. The upper half of the front end face of the case 31 protrudes forward. In this protruding region, is formed a tape feeder including a tape guide 33 made of a PET film and a tape pressing roller 34 which is pressed against the surface of the tape guide 33 by a constant elastic force. The leading edge of the tape T is placed between the tape guide 33 and the tape pressing roller 34 in an initial setting situation. A supporting element 35 for supporting the tape pressing roller 34 is disposed on a side wall of the case 31 via a coil spring 36 in such a manner that the supporting element 35 can move up and down relative to the tape guide 33. The supporting element 35 is linked to a lever 37. The lever 37 has an upper end 37*a* protruding to the outside via the upper surface of the case 31. If the upper end is pushed downward, the tape pressing roller 34 is pressed toward the tape guide 33. On the upper surface of the case 31 there are six tape width indicators 38 for indicating the width of the tape T placed inside the case.

The tape cartridge 3 is removably mounted in a mounting part 23 which is formed in the main part of the ink-jet printer. In the mounting part 23, a tape feeding roller 12 is disposed just below the tape guide 33 which defines the tape feeder. The roller 12 has large diameter portions and small diameter portions formed alternately. As described above, the open-and-close lid 105 is dispose just above the tape cartridge 3 so that the tape cartridge can be mounted or removed when the lid 105 is open.

In this embodiment, as described above, the recording medium supplying source is formed basically with the tape cartridge 3 in which the tape T is accommodated and the mounting part 23 in which the tape cartridge 3 is mounted.

As can be seen from FIG. 2, the open-and-close lid 105 has a pushing element 105*b* by which the upper end 37*a* of the lever 37 protruding upward beyond the upper surface of the tape cartridge is pushed down when the open-and-close lid 105 is closed. The open-and-close lid 105, which faces the tape width indicators 38 formed on the upper surface of the case of the tape cartridge 3, is provided with detectors 105*c* for detecting the tape width indicated by the indicators 38.

The carrying path of the tape T fed from the tape cartridge 3 will be described below. The tape T is fed out by means of the rotation of the tape feeding roller 12. A plurality of tape guide strips 13 made of a PET film are disposed in such a manner that they are in contact with the outer periphery of the short diameter portions of the tape feeding roller 12. These tape guide strips 13 ensure that the leading edge of the tape T is correctly guided in the forward direction of the carrying path. A tape guide 14 made of stainless steel is disposed at a forward position in the tape carrying path relative to the tape guide strips 13. The tape T is guided toward the printing position by the guide 14 and the tape guide strips 13 disposed opposite the guide 14. The printing position is defined by the print head 5 and the guide element 8 disposed opposite the print head 5. The surface of the guide element 8 forms a mesh filter 81 disposed on the upper surface of the ink absorber 82 composed of the ink absorbing material. After passing the printing position, the tape T is pressed against a tape guide 16 by a tape pressing roller 15, and further passes a tape cutting position 17. Then, the tape T is carried out through the tape outlet 101*b*.

The driving force transmission system relating to the tape feeding roller 12 and the head carriage 6 for holding and carrying the print head 5 will be described below. As illustrated in FIGS. 3 and 4, a tape carrying motor 18 is disposed on the inner surface of the side plate 22 of the base 2. The output shaft 18*a* of the motor is connected via a train of gears 181 to the end of the rotating axis 121 of the tape feeding roller 12. In this embodiment, the train of gears 181 has the capability of switching the power. That is, if the head carriage 6 moves toward the side plate 22 thereby pressing a protrusion 182 protruding inward from the side plate 22, then the power transmission path is switched so that the power of the motor 18 is transmitted to the capping mechanism 9. In this embodiment as described above, the means for carrying the tape serving as the recording medium is composed basically of the tape feeding roller 12, the motor 18 serving as the power source for the tape feeding roller 12, and the train of gears 181 serving as the power transmission from the motor 18 to the roller 12.

On the other hand, a head driving motor 19 is disposed on the inner surface of the other side plate 21. The output shaft 19*a* of this motor is connected to the end of the lead screw 7 via a reduction mechanism 191 including a train of gears.

The ink supplying means is basically composed of the ink tanks 4, three ink tubes 41 (41Y, 41M, 41C) through which inks are supplied from the ink tanks 4 to the print head 5, and the ink pump 11 with which inks are manually supplied in a forced fashion. The three ink tanks 4C, 4M, and 4Y contain cyan, magenta, and yellow inks, respectively, with which a color printing operation is accomplished.

In the ink-jet printer 1 of the present embodiment, the maximum allowable width of the tape T is set to W(max) as shown in FIG. 4. The print head 5 is capable of performing a printing operation in the directions across the width of tape (in the directions of the movement of the print head 5) over the maximum printing range W(p) slightly greater than the maximum allowable tape width W(max) on both right and left sides of the tape. The above-described mesh filter 81 defining the surface of the guide element 8 is disposed over the maximum printing range.

In the example shown in FIG. 4, the tape used has a width of W1, and therefore the printing range of the print head 5 is set to W(p1) including the tape width W1.

The width of the tape accommodated in the tape cartridge 3 is detected by reading the six indicators 38 disposed on the upper surface of the case 31. The tape width is determined by detecting whether the individual indicators 38 are open or not using mechanical or optical sensors forming the detector 105*c* disposed on the main part of the ink-jet printer.

Figure 6:
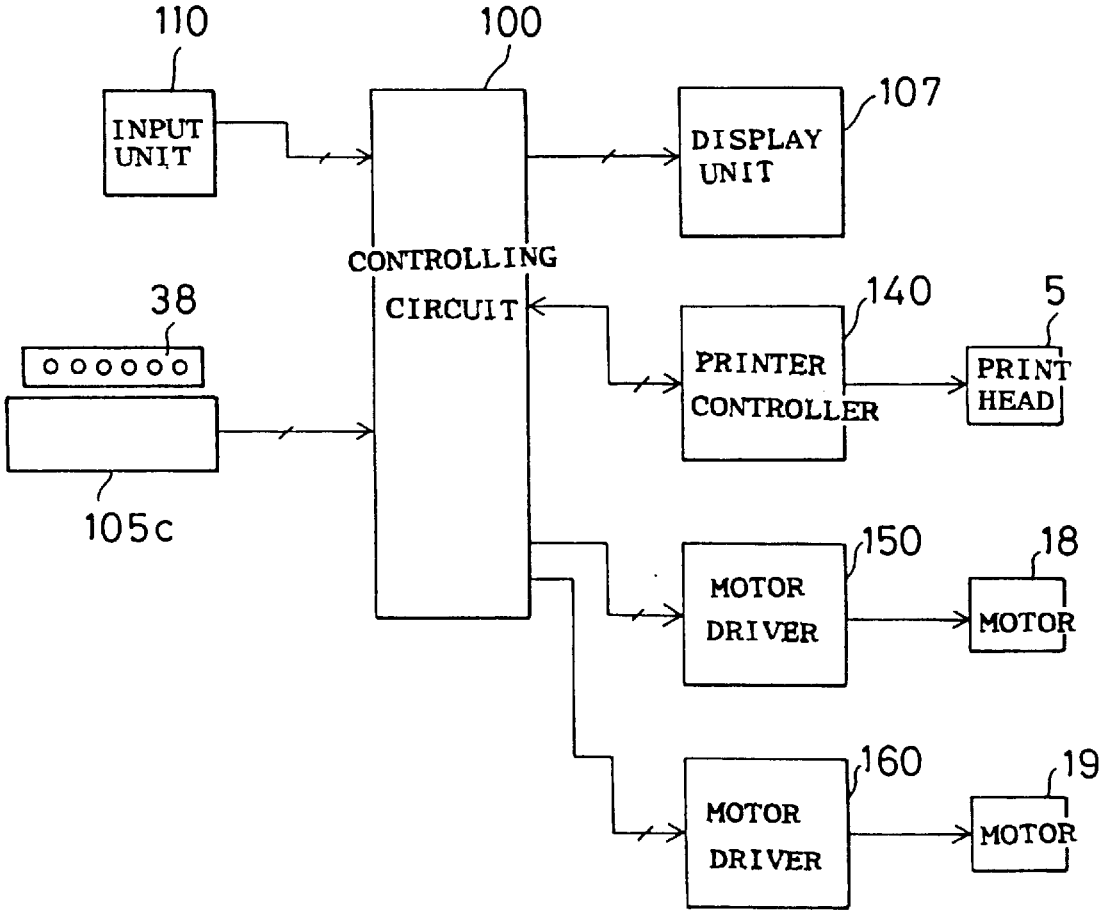
FIG. 6 is a simplified block diagram illustrating a controlling system of the ink-jet printer of FIG. 1.

FIG. 6 is a simplified block diagram illustrating a controlling system of the ink-jet printer 1 according to the present embodiment. In FIG. 6, reference numeral 100 denotes a controlling circuit constructed with a microcomputer. An input unit 110 including the keys disposed on the operation control panel 102 of the ink-jet printer 1 is connected to the inputting side of the controlling circuit 100. The detector 105*c* for detecting the tape width is also connected to the inputting side of the controlling circuit 100. The outputting side of the controlling circuit 100 is connected to the display unit 107 such as a liquid crystal display device for displaying various information, a printer controller 140 for controlling the printing operation performed by the printing head 5, and motor drivers 150 and 160 for controlling and driving the motors 18 and 19. Under the control of the controlling circuit 100 according to a control program stored in a ROM of the controlling circuit 100, the printing range is set to a value corresponding to the width of the tape accommodated in the tape cartridge 3, and a printing operation such as a solid printing operation is performed as will be described later. In the present embodiment, as described above, the controlling circuit 100 serves as the central part of the printing control and driving means.

In the ink-jet printer 1 constructed in the above-described manner, the solid printing operation for printing the tape T with ink across the entire width of the tape is performed in the manner described below. In this case, no margins are set on both sides of the width of the tape T and the printing range is set to W(p1) greater than the width W1 of the tape. The motor 18 is driven so that the tape feeding roller 12 is rotated, thereby feeding the tape T from the tape cartridge 3 toward the printing position. In synchronization with the carrying operation of the tape T, the motor 19 rotates the lead screw 7 thereby moving the print head 5 via the carriage 6. When the print head 5, after the movement in the direction denoted by the arrow in FIG. 4, has reached the point T0 prior to the edge T1 of the tape T present at the printing position, a printing operation is started. The printing operation in the forward direction is stopped when the print head 5 has reached the point T3 shown in FIG. 4 after passing the other edge T2 of the tape T.

In the ink-jet printer 1 of the present embodiment, as described above, the printing operation is performed over the range greater than the width W1 of the tape used, thereby ensuring that non-printed parts are not produced at the edge T1 or T2 of the tape T.

In the printing operation described above, ink droplets, ejected from the print head during the printing operation performed before the print head 5 reaches the edge T1 of the tape T and also during the printing operation performed after the print head 5 has passed the edge T2 of the tape T, travel toward the guide element 8 without striking the tape T. In this embodiment, since the surface 81 of the guide element 8 is disposed over the entire maximum printing range, the ejected ink droplets are captured by the surface 81 of the guide element and therefore never reach the other parts. Furthermore, in the present embodiment, the guide element 8 is composed of the mesh filter 81 and the ink absorber 82 connected to the mesh filter 81 so that the ink droplets which have reached the surface 81 of the guide element pass through the mesh filter 81 and reach the ink absorber 82 disposed behind the mesh filter 81 and thus the ink droplets are absorbed and held therein. In this way, the ink droplets are trapped via the surface of the guide element, and the following part of the tape T is not dirtied with ink droplets.

As described above, the ink-jet printer 1 of the present embodiment can perform a solid printing operation across the entire width of the tape without producing a non-printed area and without making any other part of the tape dirty with ink droplets.

After completion of a printing operation, the head carriage 6 for holding and carrying the print head 5 moves in the direction denoted by the arrow B until it returns to the end position as shown in FIG. 4. Then a rotary cutter 61 provided on the carriage 6 is driven, and the carriage 6 moves again in the direction denoted by the arrow A with the cutter 61 remaining in the projected position. As a result, a part of the tape having a particular length is cut away and carried out to the outside.

After that, the roller 12 is rotated by the motor 18 in the opposite direction so that the leading edge of the tape T returns to a position immediately prior to the printing position. Furthermore, the carriage 6 moves to the other side plate 22 so that the protrusion 182 is pressed outward by the side face of the carriage 6 thereby cutting off the linkage between the motor 18 and the tape feeding roller 12. As a result, the roller 12 stops its rotation. Instead, the capping mechanism 9 is driven so that the print head 5 is capped.

If the open-and-close lid 105 covering the mounting part 23 is opened to replace the tape cartridge 3, the tape T whose leading edge is located at the position immediately prior to the printing position is wound back until the leading edge of the tape returns to the position between the pressing roller 34 and the tape guide 33 forming the tape feeding mechanism.

In the ink-jet printer 1 of the present embodiment, as described above, when a solid printing operation is performed across the entire width of a tape, the printing range is set so that the printing range is greater than the width of the tape on both left and right sides of the tape width. Furthermore, the guide element is provided with the ink absorbing surface capable of absorbing ink over the entire range containing the maximum printing range. Therefore, it is possible to perform a solid printing operation without producing a non-printed area at edge portions of the tape. Furthermore, since the ink droplets, which are ejected during the printing operation performed when the print head is present outside either edge of the tape, are absorbed by the guide element, the following part of the tape is not dirtied with the ink droplets.

If it is desired to perform a solid printing operation in only one edge area of the tape width, the printing range is set so that the printing operation starts at a position prior to that edge of the tape width or so that the printing operation stops when the print head has moved slightly further after passing the edge of the tape width.

According to the present embodiment described above, it is possible to perform a printing operation across the entire tape width without producing a non-printed area at edge portions of the tape. It is also possible to perform a printing operation along the entire length of a tape without producing a non-printed area at a leading edge and/or a trailing edge of the tape. For example, if it is desired not to have a non-printed area at the leading edge of the tape, the printing operation is started slightly before the leading edge of the tape reaches the printing position of the print head. On the other hand, if it is desired not to have a non-printed area at the trailing edge of the tape, the printing operation is continued slightly further after the trailing edge of the tape (the ending position of printing) has passed the printing position, and the tape is cut away at the ending position of printing. In this case, the excess ink capturing means is formed in such a manner that it has an ink absorbing surface with an enough length along the tape movement direction.

Figure 7:
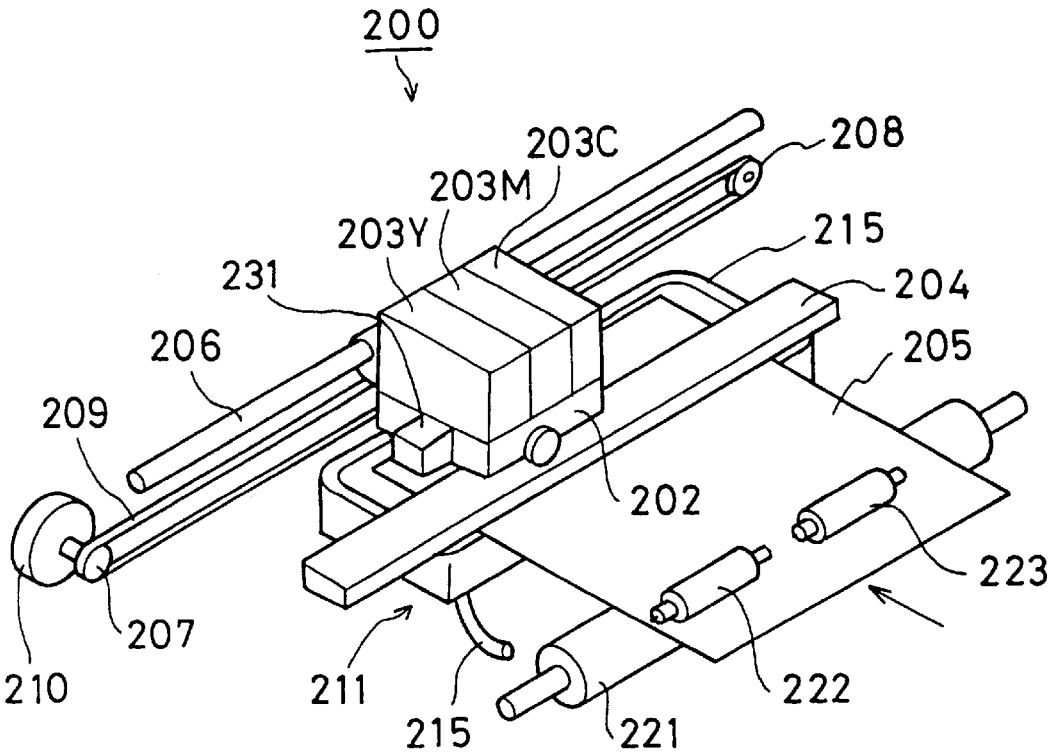
FIG. 7 is a schematic diagram illustrating the main elements of an ink-jet printer shown according to a second embodiment of the present invention.
Figure 8:
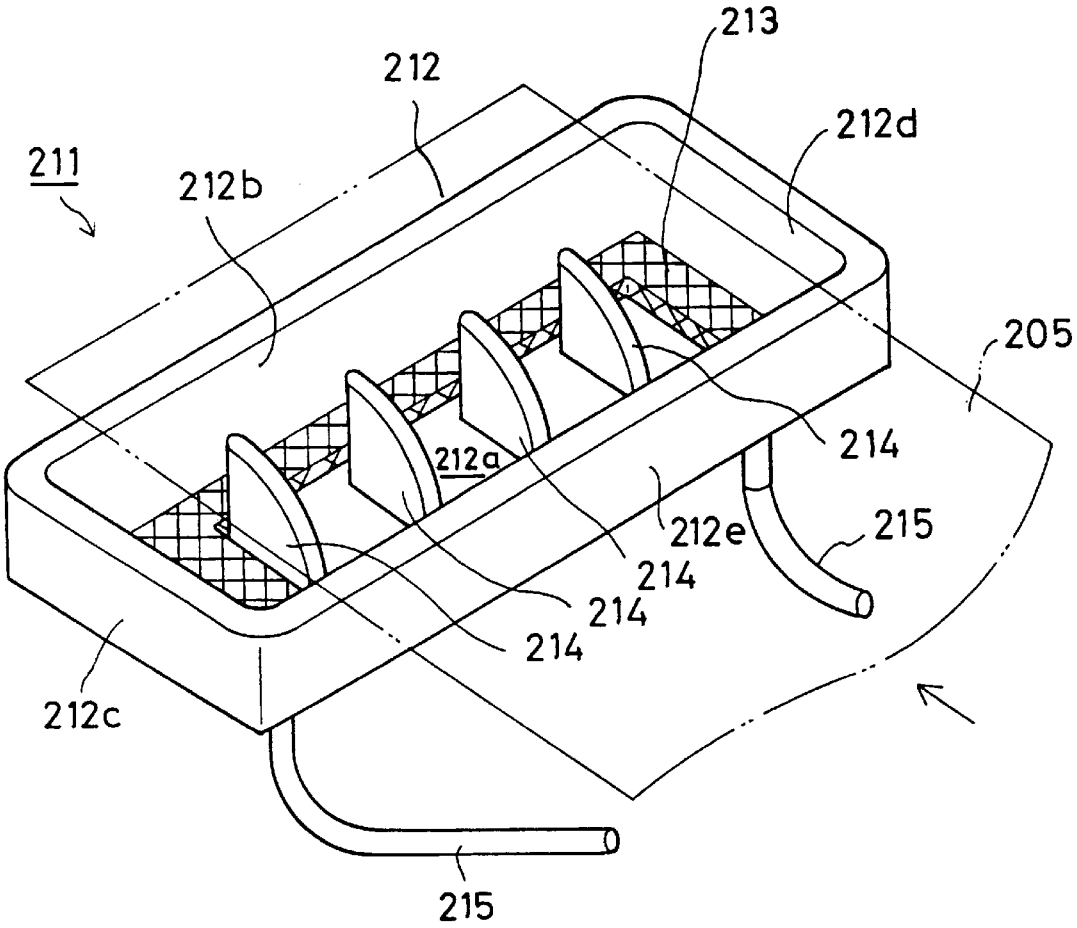
FIG. 8 is a schematic diagram illustrating a captured ink reservoir used in the printer of FIG. 7.
Figure 9:
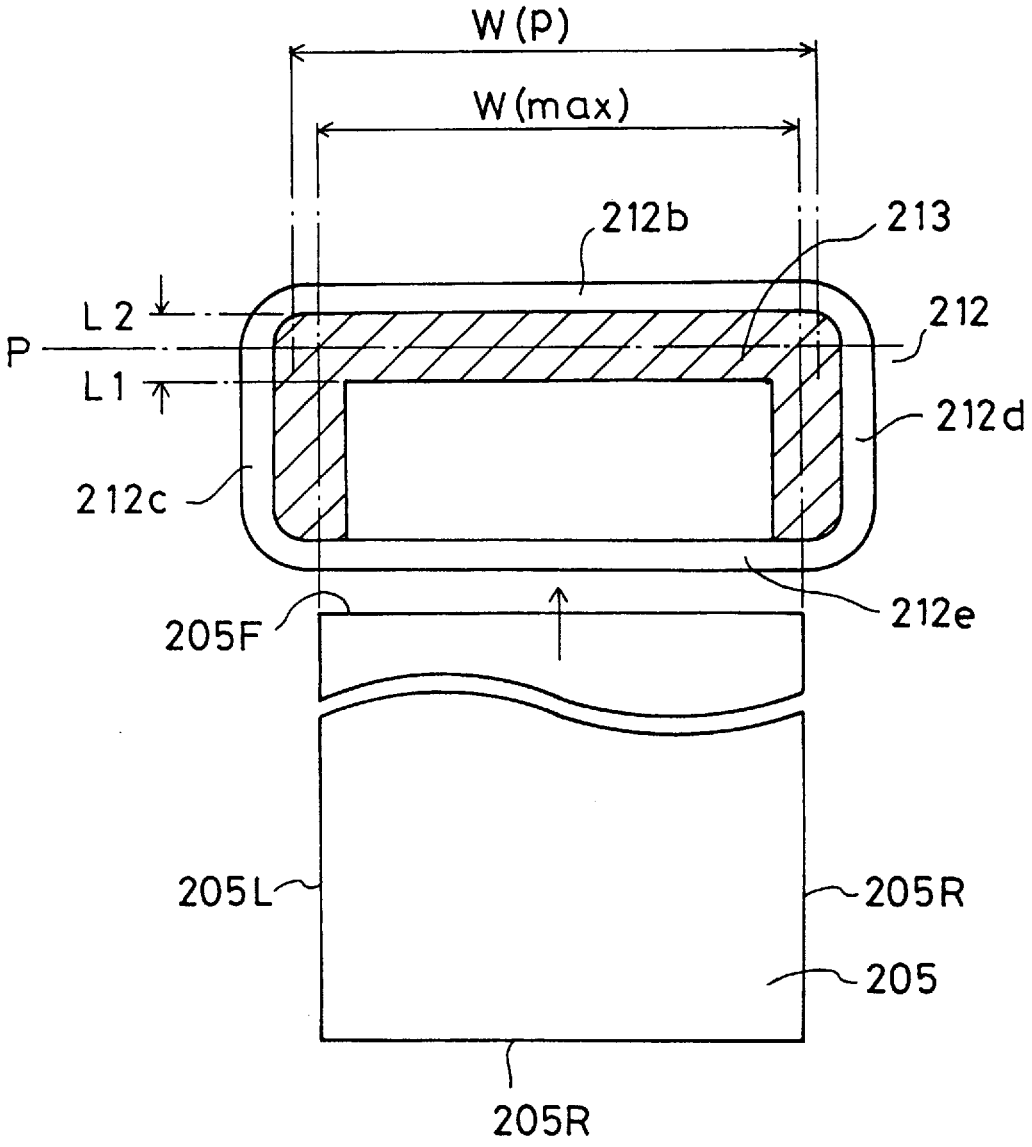
FIG. 9 is a schematic diagram for explanation of the printing operation of the printer shown in FIG. 7.

FIGS. 7, 8, and 9 illustrate the main elements of a ink-jet printer in the best mode for performing a solid printing operation on a recording medium having a great size such as a poster, although the present embodiment may also be applied to a relatively small recording medium such as a tape as in the first embodiment.

The ink-jet printer 200 according to the present embodiment is basically the same as that of the first embodiment except that the recording medium is in the form of a cut sheet such as a poster, the carriage mechanism of the print head is of the belt/pulley type, and the excess ink capturing means is constructed on the paper guide in a different manner. Thus, only those elements which are different from those in the previous embodiment will be described below.

In the ink-jet printer 200 of the present embodiment, a carriage 202 holds and carries not only a print head at its lower position but also ink cartridges 203Y, 203M, and 203C containing three color inks as shown in FIG. 7. One side of the carriage 202 is supported by a carriage guide plate 204 so that this portion of the carriage can move in both directions across the width of recording paper 205, along the surface of the carriage guide plate 204. The other side of the carriage 202 is supported by a carriage guide shaft 206 extending parallel to the guide plate 204 so that this portion can also move in both directions together with the former portion. The carriage 202, which is supported in the above-described manner, is connected to a timing belt 209 which travels between a driving pulley 207 and a driven pulley 208. The driving pulley 207 is connected to the output shaft of a carriage motor 210 so that the print head held by the carriage 202 can be moved by the motor 210 in both directions across the width of the recording paper 205.

At an upstream location of the traveling path of the recording paper 205, opposite to the carriage 202 by which the print head is held and carried, there are disposed a paper feeding roller 221 and a pair of paper pressing rollers 222 and 223 which are pressed against the outer periphery of the paper feeding roller 221. The recording paper 205 is carried through these elements toward the printing position of the print head.

A guiding element for guiding the recording paper 205 is disposed below the print head over the range including at least the reciprocating movement range of the print head. The guiding element is provided with an excess ink capturing mechanism 211. As shown in FIG. 8, the excess ink capturing mechanism 211 includes: a captured ink reservoir 212 in the form of a rectangular box having a width sufficiently greater than the width of the recording paper used; an ink absorbing material 213 disposed inside the reservoir 212; and a plurality of guide ribs 214 for guiding the recording paper to be carried. The captured ink reservoir 212 includes: a bottom plate 212*a*; and front, rear, left, and right side walls 212*b*, 212*c*, 212*d*, and 212*e* rising at the periphery of the bottom plate 212*a*; wherein the upper side of the reservoir 212 is open. The ink absorbing material 213 is disposed on the bottom plate 212*a* of the captured ink reservoir 212 in such a manner that the ink absorbing material 213 extends along the left side wall 212*c*, the rear side wall 212*b*, and the right side wall 212*d*. Vertically-protruding guide ribs 214 in the form of a sector are displaced at equal intervals in the width direction on the bottom plate 212*a* surrounded by the inner periphery of the ink absorbing material 213 and the front side wall 212*e* of the excess ink capturing reservoir. The upper ends of these ribs 214 extend to a height slightly higher than the upper end face of the captured ink reservoir 212 so that the recording paper 205 can be guided by the upper end portions of these ribs 214 when the recording paper 205 passes over the captured ink reservoir 212.

An ink exhaust means is provided at the bottom plate 212*a* of the captured ink reservoir 212. That is, ink exhausting pipes 215 are connected to the ink absorbing material 213 wherein the other ends of the ink exhausting pipes 215 are connected to an ink suction pump (not shown) so that the ink absorbing material 213 and the ink suction pump can communicate with each other.

In the printer having the above-described excess ink capturing mechanism according to the present embodiment, the areas in which the left and right portions of the ink absorbing material are located include both sides of the recording paper 205 passing over and also include the printing range W(p) which is set to a value greater than the maximum paper width W(max) as shown in FIG. 9. To perform a solid printing operation across the width of recording paper 205 without producing a non-printed area on either side of the paper, the printing operation is started when the print head has come to a position slightly prior to the edge 205L of the recording paper, and it is continued until the print head has passed the other edge 205R of the recording paper, as in the first embodiment. During the printing operation in such a mode, the ink droplets which do not arrive at the surface of the recording paper will all reach the surface of the ink absorbing material 213 of the excess ink capturing mechanism 211 and will be absorbed into the ink absorbing material 213. This ensures that the following recording paper is not dirtied with ink.

In the present embodiment, it is also possible to perform a solid printing operation in the direction of the movement of the recording paper 205 without producing a non-printed area at the leading and trailing edges of the recording paper 205, as will be described below. In FIG. 9, the printing position of the print head is denoted by line P. The printing position is set at the center of the width of the ink absorbing material in the paper movement direction (that is, at the center between lines L1 and L2). When the leading edge 205F of the recording paper has reached a position (upstream position) slightly prior to the line P, the printing operation with the print head is started. The printing operation is continued until the trailing edge 205R of the recording paper has moved slightly past the line P. This technique ensures that the solid printing operation is performed without producing a non-printed area at the leading and trailing edges (upstream and downstream edges) of the recording paper 205. Furthermore, during such a solid printing operation, the ink droplets which travel without reaching the recording paper are captured by the ink absorbing material disposed at the back side of the recording paper and absorbed into it. Therefore, this technique avoids the problem that the ink droplets are deposited on undesired portions and the following paper is made dirty with the deposited ink.

In the example described above, the ink absorbing material 213 is distributed along the three side walls. Alternatively, the ink absorbing material 213 is distributed across the entire bottom plate so that the ink absorbing material 213 has a rectangular shape. Further alternatively, the ink absorbing material 213 may have a rectangular shape with a hollow in its center. However, it is more economical and desirable that the ink absorbing material 213 be disposed only in the area to which ink droplets can reach, as in the example described above. In the present embodiment, although a small amount of ink absorbing material is disposed in a small space, no problem occurs because ink exhaust means is provided as will be described below.

That is, in the present embodiment, the ink absorbing material 213 is connected to an ink exhausting pipe 215 so that the accumulated ink may be exhausted through this ink exhausting pipe 215. This prevents the reduction in the effect of capturing the incoming ink, which would otherwise occur due to the excess accumulation of ink in the ink absorbing material 213.

Referring again to FIG. 7, in this embodiment, the width of the recording paper 205 is detected as follows: a reflection-type optical sensor 231 is attached to a side of the head carriage 202. This sensor 231 detects the edge positions of the paper width when it moves past the edge positions thereby detecting the width of the recording paper used. In response to the detected result, the printing range is set in such a manner as to have a range wider than the paper width on both sides. The sensor 231 may be attached to each side of the head carriage 202 so that both sides may be detected. Alternatively, only one sensor may be employed. In this case, before starting a printing operation, the carriage is moved across the width so as to detect the both sides of the width of the recording paper.

Figure 10:
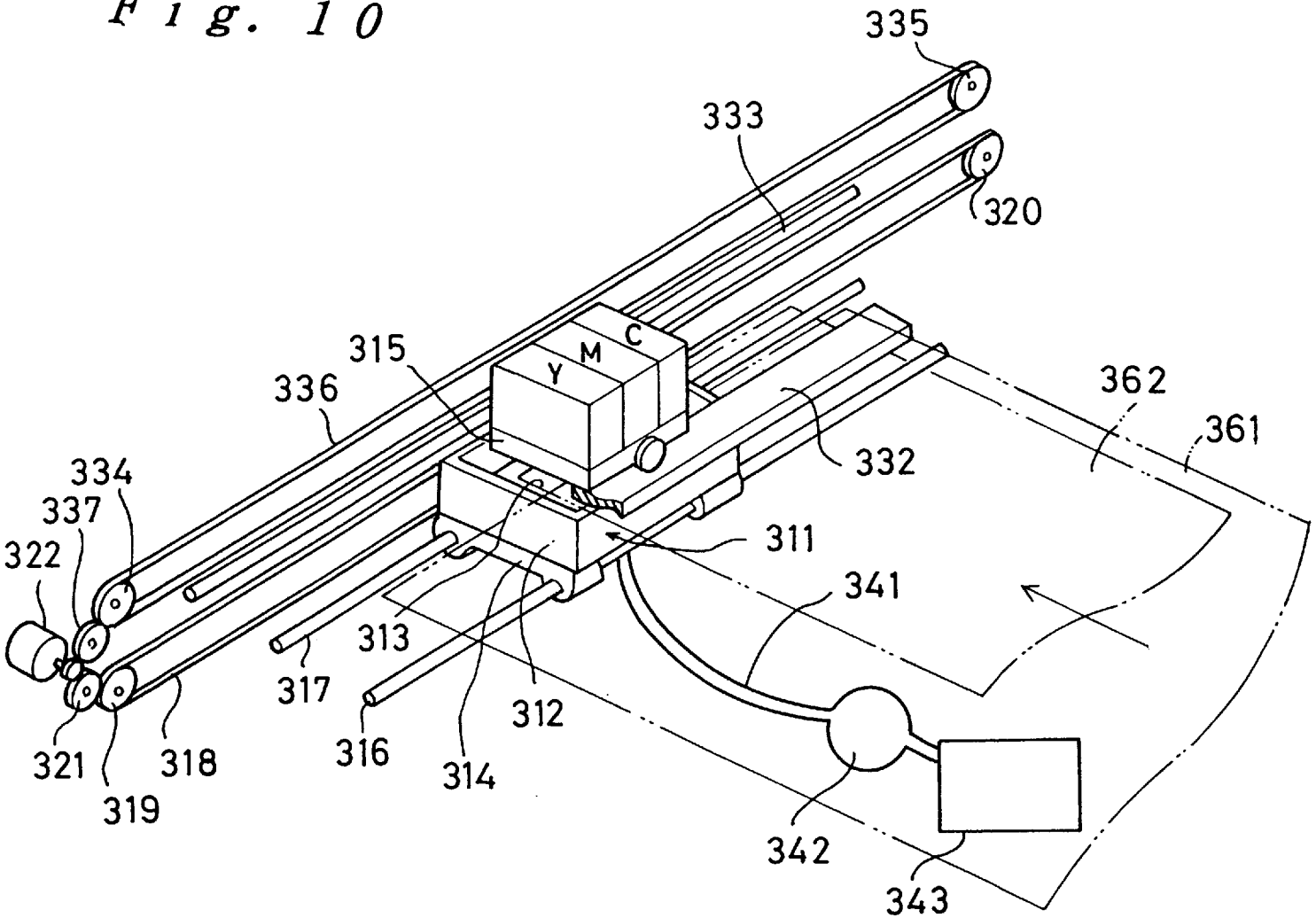
FIG. 10 is a schematic diagram illustrating the main elements of a modified ink-jet printer based on the printer of FIG. 7.

FIG. 10 illustrates a modified excess ink capturing mechanism based on the second embodiment described above. Also in this modified embodiment, the excess ink capturing mechanism 311 is composed of a captured ink reservoir 312 and an ink absorbing material 313 disposed in the captured ink reservoir 312. However, unlike the previous embodiment, the excess ink capturing mechanism 311 is adapted to move together with the print head carriage 315 in both directions.

That is, the excess ink capturing mechanism 311 is supported by the carriage 314 which is in turn supported by a pair of guide shafts 316 and 317 extending in parallel to each other so that the carriage 314 can move in both directions along the guide shafts. The carriage 314 is connected to a timing belt 318 which travels between a driving pulley 319 and a driven pulley 320. The driving pulley 319 is connected to the output shaft of a carriage motor 322 via a train of reduction gears 321. On the other hand, the head carriage 315 for holding and carrying the print head is supported so that it can move in both directions along a guide plate 332 and a guide shaft 333, as in the second embodiment. The head carriage 315 is connected to a timing belt 336 which travels between a driving pulley 334 and a driven pulley 335. The driving pulley 334 is connected to the output shaft of the above-described carriage motor 322 via a train of gears 337. In this embodiment, the two timing belts 318 and 336 are driven in synchronization with each other so that both the excess ink capturing mechanism 311 and the print head may move in one piece with each other in both directions.

A guide element 361 having a width greater than the maximum possible printing range is disposed between the head carriage 315 and the excess ink capturing mechanism 311 in such a manner that an end portion of the guide element 361 extends toward an upstream side in the paper movement path by a predetermined amount.

In the embodiment, since the excess ink capturing mechanism 311 moves together with the print head, there is no need to distribute the ink absorbing material over the range including the entire stroke of the print head, as opposed to the second embodiment. This allows a reduction in the size of the excess ink capturing mechanism. In particular, in the case of an ink-jet printer for printing large-size recording paper having a width as large as 1 m, such as a poster, the excess ink capturing mechanism that moves together with the print head has a great advantage over the excess ink capturing mechanism which is formed across the entire width of the recording paper as in the second embodiment.

In the present embodiment, it is also desirable that the ink absorbing material 313 be connected to an ink tank 343 via an ink exhausting pipe 341 so that the accumulated ink may be exhausted into the ink tank 343 by means of suction from a suction pump 342.

In the embodiments descried above, to accomplish a color printing operation, there are provided three ink tanks for accommodating cyan, magenta, and yellow color inks. However, the present invention is not limited to the application of the color printer. For example, the present invention may also be applied to an ink-jet printer provided with only one ink tank for a black ink, or for an ink of any color.

In the case of the color printing, it is more desirable that a white ink be used in addition to the three colors including cyan, magenta, and yellow. This allows high-quality reproduction for each color even when printing is performed onto a recording medium having a base color other than white.

That is, colors which can be created by mixing three colors including cyan, magenta, and yellow are limited to red, green, blue, and black. The other colors are expressed by means of area gradation based on the Dither method. As a result, these colors created by means of area gradation are poor in quality compared to the colors that can be produced by means of normal printing. Furthermore, when printing is performed onto a recording medium having a base color other than white, although black can be created by mixing the three colors, it is impossible to create white by mixing cyan, magenta, and yellow. If an white color ink is employed in addition to the above three colors, the above-described problems can be avoided.

In the previous embodiments described earlier, although the base color of a recording medium has not been discussed, a recording medium having any base color can basically be used in the printer of the present invention. If four color inks including cyan, magenta, yellow, and white inks are mounted in an ink-jet printer, it is possible to reproduce all colors onto a transparent recording medium, such as a transparent tape.

In the ink-jet printer according to the present invention, as described above, the printing range is set in such a manner as to include the entire width or the entire length of a recording medium such as a tape, so that a solid printing operation can be performed without producing a non-printed area at end portions of the recording medium.

Furthermore, in the present invention, the printer has the excess ink capturing means for capturing the ink droplets which are ejected during the printing operation performed when the print head is present at a position outside a recording medium so that those ink droplets are prevented from depositing on an undesirable portion such as the guide element thereby preventing the following recording medium from being dirtied with the deposited ink.

Furthermore, in one embodiment of the invention, there is provided the ink exhausting means for exhausting the ink accumulated in the excess ink capturing means so as to prevent the excess ink capturing means from becoming full of the captured ink thereby ensuring that the excess ink capturing means can maintain the ability of capturing the excess ink.

Furthermore, in another embodiment of the invention, the excess ink capturing means is adapted to move together with the print head. This technique is useful especially when it is desired to perform a printing operation onto a large size recording medium such as a poster since there is no need to form the excess ink capturing means over the range across the entire width or along the entire length of the recording medium.

Furthermore, in an additional embodiment of the invention, a recording medium in the form of a tape is employed wherein the tape is supplied from a tape cartridge which can be removably mounted in the main part of the ink-jet printer, so that a tape having a desired color and a desired width can be supplied by replacing the tape cartridge. In this case, the printing range may be set easily to a correct value according to the indication given by the size indication means for indicating the width of the tape accommodated in the tape cartridge.

Furthermore, if a transparent medium such as a transparent tape is employed as the recording medium, it is possible to improve the reproduction quality of colors in a solid printing operation.

While this invention has been described in conjunction with particular embodiments, still further modifications will become apparent to those skilled in the art after having the benefit of studying the specification, drawings and following claims.

What is claimed is:

1. An ink-jet printer comprising:

a recording medium supplying source;

means for defining a carrying path along which a recording medium supplied from said recording medium supplying source is carried;

recording medium carrying means for carrying said recording medium along said carrying path;

an ink-jet print head disposed on said carrying path, said ink-jet print head moving in a reciprocating fashion along a first axis on said recording medium, said first axis oriented across a width of said recording medium, which is substantially perpendicular to said carrying path;

ink supplying means for supplying ink to said print head;

excess ink capturing means for capturing ink droplets which are ejected from said print head when said print head is located at a position outward from a leading edge substantially perpendicular to a second axis of said recording medium, said second axis oriented along a length of said recording medium which is substantially parallel to said carrying path; and printing operation control means for setting a printing range of said print head along said first axis so that said printing range includes a region outside an edge of said recording medium, wherein said printing operation control means further has a capability of setting said printing range along said second axis so that said printing range in said second axis includes a region outside an edge of the recording medium.

2. The ink-jet printer according to claim 1, further comprising excess ink capturing means for capturing ink droplets which are ejected from said print head when said print head is located at a position outward from an edge along said first axis of said recording medium.

3. The ink-jet printer according to claim 2, wherein said excess ink capturing means is disposed at a location facing said printing head along said carrying path, and said excess ink capturing means is formed over an entire range including a printing range of said print head, said printing range including an area outside the edge of said recording medium.

4. The ink-jet printer according to claim 2, wherein said excess ink capturing means is disposed on a guide element which defines a position of printing performed by said print head onto said recording medium.

5. The ink-jet printer according to claim 4, wherein a surface of said guide element facing said recording medium is formed of a stainless steel mesh.

6. The ink-jet printer according to claim 2, wherein said excess ink capturing means includes ink exhausting means for exhausting captured ink.

7. The ink-jet printer according to claim 2, wherein said excess ink capturing means move with said print head.

8. The inkjet printer according to claim 1, wherein said recording medium is a tape having a substantial length and having a constant width.

9. The ink-jet printer according to claim 8, wherein said recording medium supplying source is a tape cartridge in which a tape wound in the form of a roll is accommodated, said tape cartridge removably mounted adjacent to said recording medium carrying means.

10. The ink-jet printer according to claim 9, wherein said tape cartridge further includes width indication means for indicating a width of said tape accommodated in said tape cartridge, said printing operation control means includes reading means for reading said width indicated by said width indication means, and said printing range of said print head in a first axis is set according to said width read by said reading means so that said printing range includes an area outside an edge of said recording medium.

11. The ink-jet printer according to claim 8, wherein said recording medium is transparent tape.

12. The ink-jet printer according to claim 1, wherein said recording medium is transparent.

13. The ink-jet printer according to claim 1, wherein said print head performs a solid printing.

14. The ink-jet printer according to claim 1, wherein said recording medium carrying means moves in a first direction along said second axis, said first direction advancing a first printed region of said recording medium away from said recording medium supply source, and said recording medium carrying means optionally moves in a second direction, substantially opposite said first direction, moving said first printed region of said recording medium between said print head and said recording medium supply source to allow printing on a second region of said recording medium, said second region preceding said first region when said recording medium is moving in a first direction.

15. The ink-jet printer according to claim 14, wherein said second region is a leading edge of said recording medium, and wherein said print head ejects droplets into said excess ink capturing means as said recording medium moves is a first direction toward said print head.

16. The ink-jet printer according to claim 15, wherein said carrying medium moves said leading edge of said recording medium under said print head to allow printing on said leading edge.

17. A printer comprising:

a cartridge for supplying a recording medium;

means for defining a path along which the recording medium supplied from the cartridge is conveyed in a first direction away from the cartridge or in a second direction substantially opposite the first direction;

a reversible recording medium drive mechanism for moving the recording medium in the first direction away from the cartridge, the drive mechanism operable in a reverse direction for moving the recording medium in the second direction toward the cartridge;

a print head movably supported across a region greater than a width of the recording medium along a first axis substantially perpendicular to the path and disposed on the path;

at least one print medium source operationally associated with the print head; and controlling means operably connected to the print head for enabling printing outboard of the recording medium;

wherein the controlling means sets a printing range of the print head along the first axis on the recording medium so that the printing range includes a region outside an edge of the recording medium and sets the printing range along the second direction so that the printing range includes a region outside an edge of the recording medium, and wherein after the recording medium has advanced in the first direction along the path subsequent to printing a first region, the recording medium drive mechanism is reversed to convey the recording medium in the second direction moving the first printed region of the recording medium to a position between the print head and the cartridge to permit printing on a second region of the recording medium, the second region preceding the first region when the recording medium is moving in the first direction.

18. The printer according to claim 17 further comprising at least one sensor coupled to the print head for detecting an edge of the recording medium.

19. The printer according to claim 17 further comprising at least one indicator for determining a width of the recording medium.

20. The printer according to claim 17, wherein the printer is an ink-jet printer, the print head is an ink-jet print head and the print source is an ink source in fluid communication with the ink-jet print head.

21. The printer according to claim 20, further comprising an excess ink capturing mechanism for capturing ink droplets which are ejected from the print head when the print head is located at a position outward along the path from an edge of the recording medium.

22. The printer according to claim 21, wherein the ink capturing mechanism further includes an ink exhausting means for exhausting captured ink.

23. The printer according to claim 22, wherein the ink exhausting means is an ink exhausting pipe fluidly communicating between the ink capturing mechanism and a captured ink reservoir.

24. The printer according to claim 21 wherein the ink capturing mechanism includes an ink capturing surface subtending a printing range of the ink-jet print head.

25. The printer according to claim 21, wherein the ink capturing mechanism moves synchronously with the ink-jet print head.

26. The printer according to claim 21, wherein the excess ink capturing mechanism further includes an ink absorber and an ink filter attached thereto.

27. The printer according to claim 26, wherein the ink filter is a stainless steel mesh.

28. The printer according to claim 20, wherein the movable support for the print head is a drive mechanism and a print head carriage, the print head removably coupled to the carriage, the carriage operably associated with the carriage drive mechanism, the printer further comprising a carriage drive motor operably connected to the carriage drive mechanism to cause movement of the ink-jet print head, wherein the control means includes at least one detector for detecting the width of the recording medium and operably connected to the ink-jet print head for selectively causing ink dispersion in a region outboard of the recording medium.

29. The printer according to claim 28, wherein the carriage drive mechanism is a lead screw supporting the carriage and the carriage drive motor is operably connected to the lead screw for rotating the lead screw to cause movement of the print head.

30. The printer according to claim 28, wherein the carriage drive mechanism is a timing belt coupled to the carriage and the carriage drive motor is operably connected to the timing belt to cause movement of the ink-jet print head.

31. The printer according to claim 28, further comprising a print head capping mechanism having a capping face closing an ink outlet of the ink-jet print head during idle periods.

32. The printer according to claim 31, further comprising a switch for directing power at the motor between the carriage drive mechanism and the head capping mechanism.

33. The printer according to claim 28, further including a carriage guide mechanism associated with the carriage, the guide mechanism guiding the moving carriage in a first axis direction and substantially inhibiting rotation about the first axis.

34. The printer according to claim 17, further including a reversible recording medium drive motor operably associated with the cartridge drive mechanism.

35. The printer according to claim 17, further comprising:

a recording medium cutter disposed along the recording medium carrying path, the print head lying along the path between the cartridge and the cutter, the cutter cutting the recording medium when the first printing is between the print head and the cutter to reveal a leading edge of the recording medium in the vicinity of the first printing region.

36. The printer according to claim 35, wherein the means for defining the recording medium path further includes at least one recording medium guide and a pressing roller disposed along the path between the print head and the cartridge in the region of the print head, the recording medium passing therebetween in contact with both the guide and the roller, and wherein the leading edge of the recording medium is brought between the guide and the pressing roller after a first printing and cutting by the reversed recording medium drive mechanism operating in the second direction, the leading edge available for a second printing when the recording medium drive mechanism is thereafter operated in a first direction.

37. A printer comprising:

a cartridge for supplying a recording medium;

means defining a path including at least one recording medium guide and at least one recording medium pressing roller and conveying the recording medium supplied from the cartridge along the path;

an ink-jet print head movably supported on a lead screw and further supported on a guide plate across a region greater than a width of the recording medium, the ink-jet printhead being disposed on the path;

a motor operably connected to the lead screw for rotating the lead screw to cause movement of the ink-jet print head;

at least one ink supply source fluidly communicating with the inkjet print head;

controlling means, including at least one detector for detecting the width of the recording medium and operably connected to the ink-jet print head for selectively causing ink dispersion in a region outboard of the recording medium;

a printhead capping mechanism having a capping face closing an ink outlet of the ink-jet print head during idle periods; and a switch for directing power at the motor between the lead screw and the head capping mechanism, wherein the controlling means sets a printing range of the ink-jet print head along a first axis on the recording medium so that the printing range includes a region outside an edge of the recording medium and sets the printing range along a second axis different from the first axis on the recording medium so that the printing range includes a region outside an edge of the recording medium.

38. A printer comprising:

means for supplying a cut sheet recording medium having a width along a first axis, the width defined by a first side edge and a second side edge, and a leading edge and a trailing edge along a second axis, the second axis substantially perpendicular to the first axis;

means for defining a path including at least one recording medium guide and at least one recording medium pressing roller for conveying the leading edge of the recording medium along the path;

an ink-jet print head moveably supported on a guide shaft and further supported on a guide plate across a region greater than the width of the recording medium, the ink-jet print head being disposed on the path;

a timing belt secured to the ink-jet print head;

a motor operably connected to the timing belt for causing movement of the ink-jet print head;

at least one ink supply source fluidly communicating with the ink-jet print head;

excess ink capturing means for capturing ink droplets which are ejected from the print head when the print head is located at a position outward from an edge of the cut sheet recording medium; and a printing operation control means for setting a printing range including at least one detector for selectively causing ink dispersion in a region outward from an edge of the recording medium, wherein the control means sets a print range of the ink-jet print head in the first axis on the recording medium so that the print range includes a region outside an edge of the recording medium and sets the printing range in the second axis on the recording medium so that the print range includes a region outside the leading and trailing edges of the recording medium.

39. The printer according to claim 38, wherein the cut sheet recording medium is a large poster-sized cut sheet.

* * * * *